United States Patent [19]

Honma

[11] Patent Number: 4,776,580

[45] Date of Patent: Oct. 11, 1988

[54] DRIVE MECHANISM FOR PAPER DELIVERY ROLLERS IN AN ELEVATOR-TYPE SORTER

[75] Inventor: Tomio Honma, Kawasaki, Japan

[73] Assignee: Duplo Seizo Kabushiki Kaisha, Tokyo, Japan

[21] Appl. No.: 32,481

[22] Filed: Mar. 30, 1987

[30] Foreign Application Priority Data

Dec. 5, 1986 [JP] Japan ..... 61-186756[U]

[51] Int. Cl.[4] ..... B65H 39/10

[52] U.S. Cl. ..... 271/296

[58] Field of Search ..... 271/296, 302, 303, 292, 271/293, 294

[56] References Cited

U.S. PATENT DOCUMENTS

| | | | |
|---|---|---|---|
| 4,068,837 | 1/1978 | Lamos | 271/296 |
| 4,216,955 | 8/1980 | Auritt | 271/296 |
| 4,405,225 | 9/1983 | Perrault | 271/296 X |

*Primary Examiner*—Richard A. Schacher

*Attorney, Agent, or Firm*—Christensen, O'Connor, Johnson & Kindness

[57] ABSTRACT

Disclosed is a mechanism for driving the paper delivery rollers in an elevator of an elevator-type sorter. The elevator is adapted to move through a passage that extends between the conveyor belt and the inner ends of a plurality of shelves. Paper sheets are delivered to the shelves through a deflecting path defined by the internal framework of the elevator. The paper sheets are fed onto the shelf by paper delivery rollers which are driven by a series of gears and a toothed belt mounted on the elevator. The gears are, in turn, driven by a rubber "tumbling roller" which is mounted in a pivotable bracket. This bracket is biased by a spring to bring the tumbling roller into contact with the conveyor belt so that its movement imparts a rotational motion to the tumbling roller.

3 Claims, 3 Drawing Sheets

DRIVE MECHANISM FOR PAPER DELIVERY ROLLERS IN AN ELEVATOR-TYPE SORTER

TECHNICAL FIELD

This invention generally relates to a mechanism to drive the paper delivery rollers provided in an elevator of an elevator-type sorter, and thereby to deliver paper sheets onto respective shelves of the sorter and, more particularly, to the mechanism by which a driving force for the paper delivery rollers is directly obtained from a paper sheet conveyor belt.

BACKGROUND INFORMATION

In an elevator-type sorter of the conventional type, paper delivery rollers associated with each paper receiving shelf are driven by a toothed belt that extends along the side of the sorter housing. Each paper delivery roller is affixed to a shaft that is rotatably mounted in the sorter housing, and gears are attached to an extending end of the shaft and are driven by the toothed belt to turn the paper delivery rollers.

With the above-described construction of the prior art, provision of the toothed belt or similar driving mechanism to rotate the paper delivery rollers at each shelf position disadvantageously increases the number of parts and correspondingly raises the manufacturing cost of the sorter.

In view of such problems, the present invention is intended to provide an improved drive mechanism for the paper delivery rollers of an elevator-type sorter. In addition, it is intended that such a sorter be constructed of a reduced number of parts and manufactured at a significantly lower cost in contrast with the elevator-type sorter paper drive roller mechanisms of the prior known art.

These and other objects of the present invention will be apparent from the description of the preferred embodiment that follows and the attached drawings.

SUMMARY OF THE INVENTION

The subject invention is intended for use in a sorter of the elevator-type that includes a conveyor belt for moving paper sheets through the sorter from a point where the sheets are first introduced from a source device, e.g., copier or printer. A plurality of paper sheet receving shelves are arranged next to each other in the direction in which the paper sheets are conveyed. An elevator moves between the belt and the inner ends of the shelves to deliver the paper sheets onto each respective shelf. Within the elevator, a deflecting path is provided to deflect the paper sheets that are conveyed by the belt toward a particular shelf. Paper delivery rollers in the elevator deliver the paper sheets that have traveled along the deflecting path onto the shelf.

To drive the paper delivery rollers, the elevator is provided with a tumbling roller and means for biasing the tumbling roller into contact with the moving conveyor belt. In addition, the drive mechanism includes means for transmitting the rotational force of the tumbling roller to the paper delivery rollers.

DESCRIPTION OF THE PREFERRED EMBODIMENT

Figure 1:
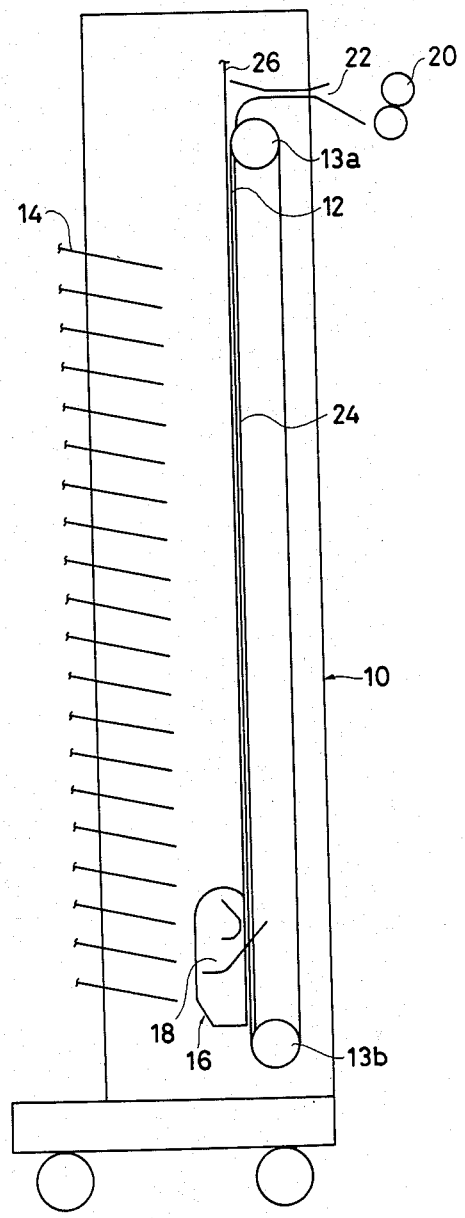
FIG. 1 is a schematic diagram illustrating a preferred embodiment of an elevator-type sorter to which the present invention is applied.

FIG. 1 illustrates an embodiment of an elevator-type sorter generally denoted by reference 10, to which the present invention has been applied. Sorter 10 is centrally provided with a vertically extending single endless flat belt 12 for conveying sheets. Belt 12 is supported at its upper and lower ends by pulleys 13A, and 13B, respectively, that are continuously rotated to drive the belt by a separate drive mechanism (not shown), in a counterclockwise direction relative to the view in FIG. 1.

A plurality of paper sheet receiving shelves 14 are arranged one above the other and each of these shelves 14 is slighty inclined upward from its inner end towards its outer end. Between belt 12 and the inner ends of the respective shelves 14, there is provided an elevator 16 which moves vertically to deliver paper sheets to respective ones of shelves 14. Separate control and drive mechanisms (not shown) cause elevator 16 to be intermittently moved in a repetitive fashion from its upper end position to its lower end position in such a manner that it stops at a position corresponding to each shelf 14. Elevator 16 includes a deflecting path 18 for changing the course of movement of each paper sheet, and a plurality of pairs of paper delivery rollers 42, 44, as will be described herein below.

A pair of rollers which are part of the mechanism provided in a paper sheet source device, e.g., a printer or copying machine, are designated by reference number 20. It is by means of rollers 20 that respective paper sheets are delivered through an inlet 22 into sorter 10. Paper sheets are then transported along conveyor belt 12, and deflected along path 18 each time elevator 16 stops at a position corresponding to an associated shelf 14. Having followed path 18, each paper sheet is delivered to the shelf by pairs of delivery rollers 42 and 44. Elevator 16, starting from its upper end position, is successively stopped at the positions corresponding to the respective shelves 14 so that the paper sheets to be sorted are delivered one by one onto shelves 14, and proper distribution thereof is thereby achieved.

Figure 2:
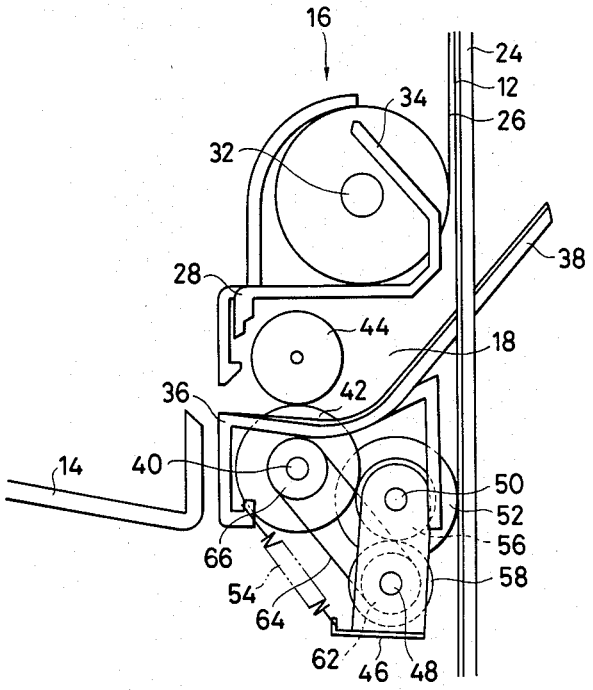
FIG. 2 is a side view illustrating in detail the relationship between the conveyor belt and the elevator.
Figure 3:
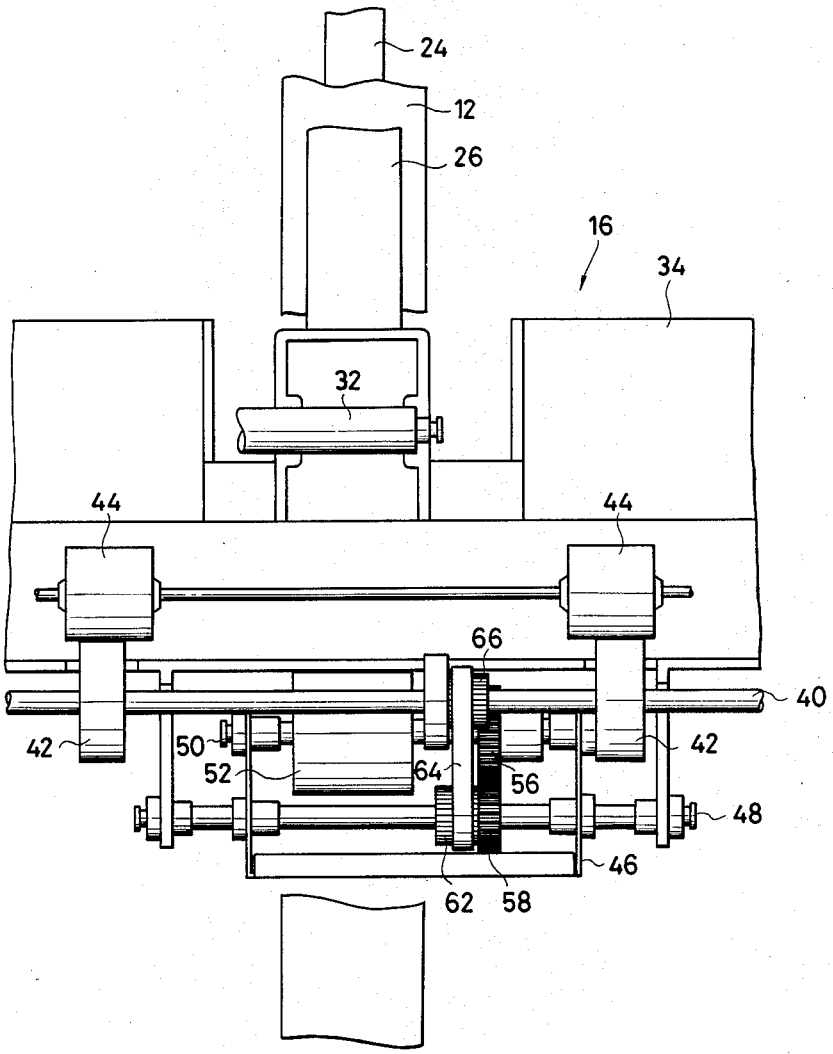
FIG. 3 is a front view illustrating in detail the relationship between the conveyor belt and the elevator.
Figure 4:
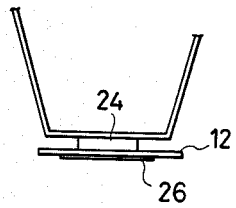
FIG. 4 is a plan view illustrating details of the conveyor belt.

FIGS. 2 and 3 illustrate in detail the relationship between the conveyor belt 12 and elevator 16. There is provided behind conveyor belt 12 a magnetic strip 24 which is stationary relative to the housing of sorter 10, and which extends vertically, substantially over the distance along which elevator 16 can be moved. In front of conveyor belt 12, there is provided a steel ribbon 26 which is magnetically biased toward belt 12 by magnetic strip 24 (see FIG. 4). The paper sheets conveyed by belt 12 pass through a gap defined between the belt and the steel ribbon 26.

Steel ribbon 26 has its upper end affixed to a frame member (not shown) provided within sorter 10 and its lower end attached to a shaft 32 which is, in turn, supported in an upper frame member 28 of elevator 16. Ribbon 26 has such an elasticity that the ribbon tends to take a spiral coiled form when it is released in a free condition, and is adapted to be repeatedly wound and unwound as elevator 16 is moved up and down.

The upper frame 28 of elevator 16 has an extension which serves as a guide 34 curved leftward, as viewed in FIG. 2, and a lower frame member 36 of elevator 16 has an extension which serves as a guide 38 extending right and upwards, as viewed in FIG. 2. These guides 34 and 38 together define the above-mentioned paper sheet deflecting path 18. As noted above, path 18 is provided at its outlet with a plurality of pairs of paper delivery rollers 42, 44 (see FIG. 3), of which the driving rollers 42 are supported by a shaft 40 in the lower frame 36, and the driven rollers 44 are are supported in the upper frame 28.

Lower frame 36 is provided at its lower portion with a bracket 46 mounted so as to pivot around a shaft 48 which is, in turn, rotatably supported in lower frame 36. A tumbling roller 52, formed of rubber, is secured to a shaft 50 that is supported in the upper portion of bracket 46. A tension spring 54 is suspended between the lower free end of bracket 46 and the end of lower frame 36, adjacent the column of shelves 14. Under action of tension spring 54, bracket 46 is biased around shaft 48 in a clockwise direction, as seen in FIG. 2. In consequence, tumbling roller 52 is biased into contact with the conveyor belt 12 at a position below the deflecting path 18, i.e., across said path from the paper inlet. Accordingly, during operation, roller 52 is continuously rotated clockwise as seen in FIG. 2 as conveyor belt 12 continuously travels counterclockwise as seen in FIG. 1.

A gear 56 is fixed on shaft 50 of roller 52, and gear 56 engages a gear 58 that is fixed on shaft 48. A gear 62 is integrally connected to gear 58, and operatively drives a gear 66 by means of a toothed belt 64. Gear 66 is fixed on shaft 40 of the paper delivery rollers 42. Accordingly, a rotating force provided by rubber roller 52 is transmitted via the gears 56, 58, 62, belt 64 and gear 66, in this order, to the paper delivery rollers 42 which are thereby rotated counterclockwise as seen in FIG. 2.

In an assembly of said paper delivery rollers 42, gear 56 has a diameter that is equal to that of gear 58. Likewise, gear 52 has a diameter equal to that of gear 66, and roller 52 has a diameter equal to that of roller 42, so that the circumferential velocity of roller 52 is equal to that of roller 42, i.e, the paper feed velocity of belt 12 is equal to the rotational speed of rollers 42. Accordingly, the pairs of the paper delivery rollers 42, 44 can deliver paper sheets as they are deflected through path 18 onto respective shelves 14 without any undesirable flexure or forcible tension.

Although the present invention has been described hereinabove with respect to a particular embodiment in which the sorter is equipped with a single conveyor belt, it should be understood that in a sorter having a plurality of conveyor belts, the mechanism according to the present invention may be associated with each of these conveyor belts or selectively associated with one or more of said conveyor belts. The sorter which has been described above and is illustrated in the accompanying drawings is of the upright type into which the paper sheets are introduced near its top. The present invention is also applicable to a sorter of the type in which the paper sheets are introduced from a point adjacent the bottom, or one in which they are introduced and conveyed laterally, these changes being accomplished merely by turning the mechanism illustrated upside down or by lying it down on its side.

These and other modifications to the preferred embodiment disclosed hereinabove will be apparent to those skilled in the art. While the invention has been described with reference to the preferred embodiment and alternatives thereto, it should be clearly understood that the invention is not limited thereto. Rather, the scope of the invention is to be determined only by reference to the appended claims.

The embodiments of the invention in which an exclusive property or privilege is claimed are defined as follows:

1. In a sorter of the elevator type, including a conveyor belt for paper sheets extending along a plane in a direction in which the paper sheets are conveyed, a plurality of paper sheet receiving shelves arranged adjacent each other along the direction in which the paper sheets are conveyed, an elevator adapted to be moved along a passage defined between the conveyor belt and inner ends of respective shelves along the direction in which the paper sheets are conveyed, a deflecting path provided in the elevator to deflect the paper sheets conveyed by the belt toward the respective shelves, and paper delivery rollers provided in the elevator to deliver the paper sheets deflected by said deflecting path onto the respective shelves, a drive mechanism for the paper delivery rollers comprising:

a tumbling roller rotatably mounted in a bracket, said bracket being pivotally connected to the elevator;

spring means for applying a spring force to the bracket to bias the tumbling roller into contact with the conveyor belt by rotating the bracket about its pivotal connection to the elevator so that movement of the conveyor belt in the plane in which it extends imparts a rotational motion to the tumbling roller; and means for transmitting the rotational motion of the tumbling roller to the paper delivery roller, said means comprising gear means for drivingly connecting the tumbling roller to an idler and belt means for drivingly connecting the idler to the paper delivery rollers.

2. A drive mechanism according to claim 1, wherein said tumbling roller comes into contact with the conveyor belt on a side of the deflecting path that is opposite a side on which paper sheets are introduced into the sorter.

3. A drive mechanism according to claim 1, wherein said belt means comprises a first and a second gear and a belt having teeth that mesh with the first and second gears.

* * * * *